US006176111B1

(12) United States Patent
Lewis

(10) Patent No.: US 6,176,111 B1
(45) Date of Patent: Jan. 23, 2001

(54) DRUM SECURITY SYSTEM

(76) Inventor: Ray D. Lewis, P.O. Box 51077, Detroit, MI (US) 48150

( * ) Notice: Under 35 U.S.C. 154(b), the term of this patent shall be extended for 0 days.

(21) Appl. No.: 09/388,424

(22) Filed: Sep. 1, 1999

(51) Int. Cl.[7] ..... F16B 41/00
(52) U.S. Cl. ..... 70/230; 70/164
(58) Field of Search ..... 70/230, 229, 158–180

(56) References Cited

U.S. PATENT DOCUMENTS

| | | | | |
|---|---|---|---|---|
| 2,791,898 | * | 5/1957 | Pegg et al. | 70/230 |
| 3,752,254 | * | 8/1973 | Carley et al. | 70/230 X |
| 3,826,115 | * | 7/1974 | Davis | 70/230 X |
| 4,426,863 | | 1/1984 | Gillette et al. | 70/164 |
| 4,655,060 | | 4/1987 | Jakubas | 70/230 |
| 4,788,840 | | 12/1988 | Wilson, Jr. | 70/164 |
| 4,959,980 | | 10/1990 | Phillips | 70/158 |
| 5,199,286 | | 4/1993 | Jakubas | 70/230 |
| 5,267,688 | * | 12/1993 | Benefield | 70/94 X |
| 5,596,892 | | 1/1997 | Edgar et al. | 70/164 |
| 5,826,447 | * | 10/1998 | Campbell | 70/230 X |

* cited by examiner

*Primary Examiner*—Suzanne Dino Barrett
(74) *Attorney, Agent, or Firm*—Joseph N. Breaux

(57) ABSTRACT

A drum security system that includes a drum top and plug assemblies which are inserted and locked in connection with the threaded access openings of the drum top of the system which is secured to a drum to seal the access openings and prevent unauthorized access to the contents of the drum.

1 Claim, 4 Drawing Sheets

DRUM SECURITY SYSTEM

TECHNICAL FIELD

The present invention relates to storage drums and more particularly to a drum security system that includes a drum top having two spaced threaded drum access openings spaced apart on enters a predetermined access opening gap distance; and two identical drum plug assemblies; each drum plug assembly including a threaded drum sealing plug threaded for engaging and sealing one both of the two threaded drum access apertures of the drum top, a locking bar assembly rigidly secured at one bar end to a top of the threaded drum sealing plug and having a locking plate with a lock bolt receiving aperture provided at a second bar end thereof; the drum plug assembly measuring one half of the predetermined access opening gap distance between a center point of the drum top of the threaded drum sealing plug and the locking plate.

BACKGROUND ART

It is often necessary to prevent access to chemicals and the like stored in a storage drum. The drums are typically provided with a drum top having two threaded access opening and two screw in plugs. It would be a benefit, therefore, to have a drum security system that included plug assemblies which could be inserted and locked within the threaded access openings of a drum top to seal the access openings and prevent unauthorized access to the contents of the drum.

GENERAL SUMMARY DISCUSSION OF INVENTION

It is thus an object of the invention to provide a drum security system that includes a drum top having two spaced threaded drum access openings spaced apart on centers a predetermined access opening gap distance; and two identical drum plug assemblies; each drum plug assembly including a threaded drum sealing plug threaded for engaging and sealing one of the two threaded drum access apertures of the drum top, a locking bar assembly rigidly secured at one bar end to a top of the threaded drum sealing plug and having a locking plate with a lock bolt receiving aperture provided at a second bar end thereof; the drum plug assembly measuring one half of the predetermined access opening gap distance between a center point of the drum top of the threaded drum sealing plug and the locking plate.

Accordingly, a drum security system is provided. The drum security system includes a drum top having two spaced threaded drum access openings spaced apart on centers a predetermined access opening gap distance; and two identical drum plug assemblies; each drum plug assembly including a threaded drum sealing plug threaded for engaging and sealing one of the two threaded drum access apertures of the drum top, a locking bar assembly rigidly secured at one bar end to a top of the threaded drum sealing plug and having a locking plate with a lock bolt receiving aperture provided at a second bar end thereof; the drum plug assembly measuring one half of the predetermined access opening gap distance between a center point of the drum top of the threaded drum sealing plug and the locking plate.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
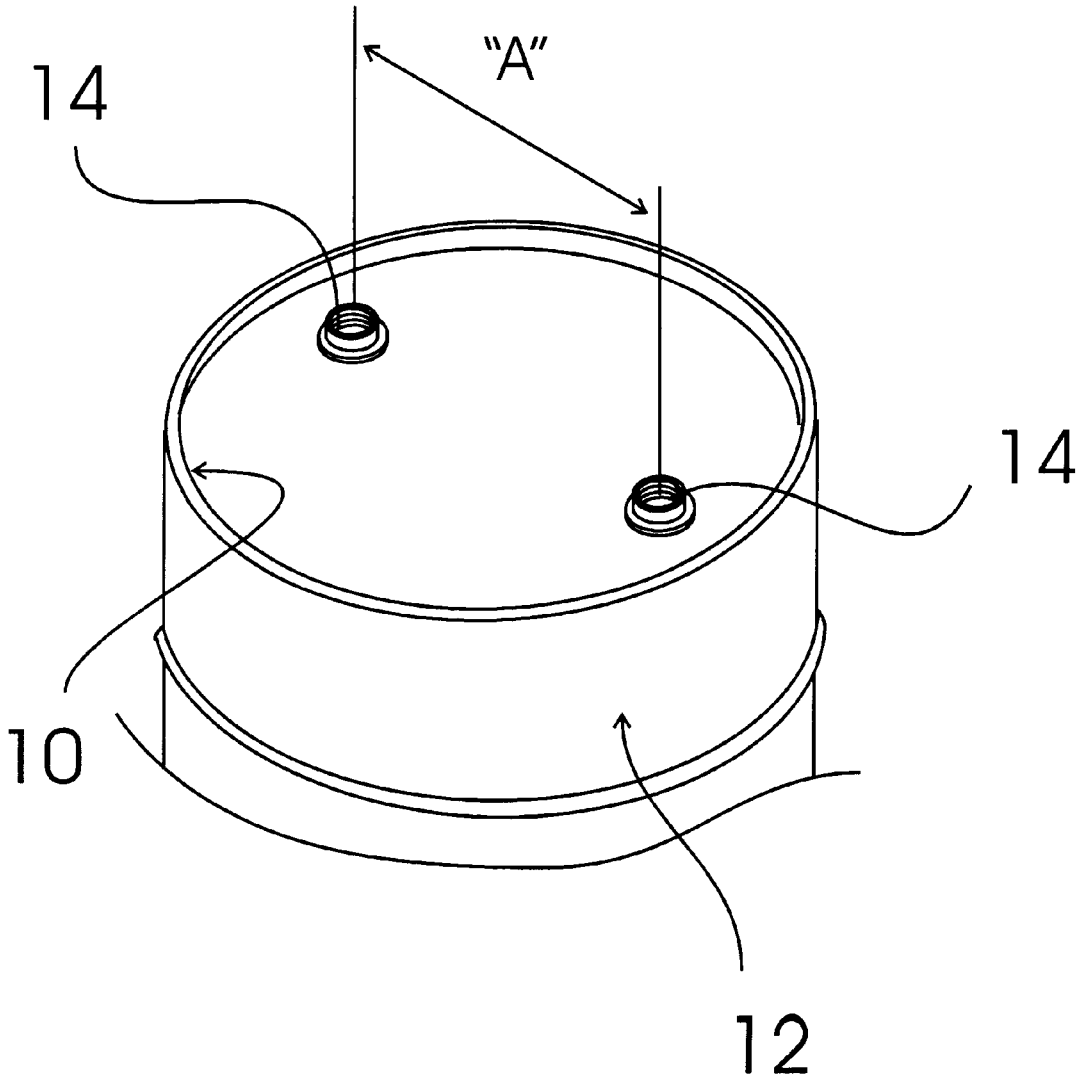
FIG. 1 is a partial perspective view of an exemplary drum top of the drum security system of the present invention showing the two spaced threaded drum access openings spaced apart on centers a predetermined access opening gap distance.

FIG. 1 shows an exemplary drum top of the drum security system of the present invention, generally designated 10, secured to a representative drum container 12. Drum top 10 includes two spaced threaded drum access openings 14 spaced apart on centers a predetermined access opening gap distance "A". In this embodiment drum top 10 is a convention drum top and is supplied with drum 12.

Figure 2:
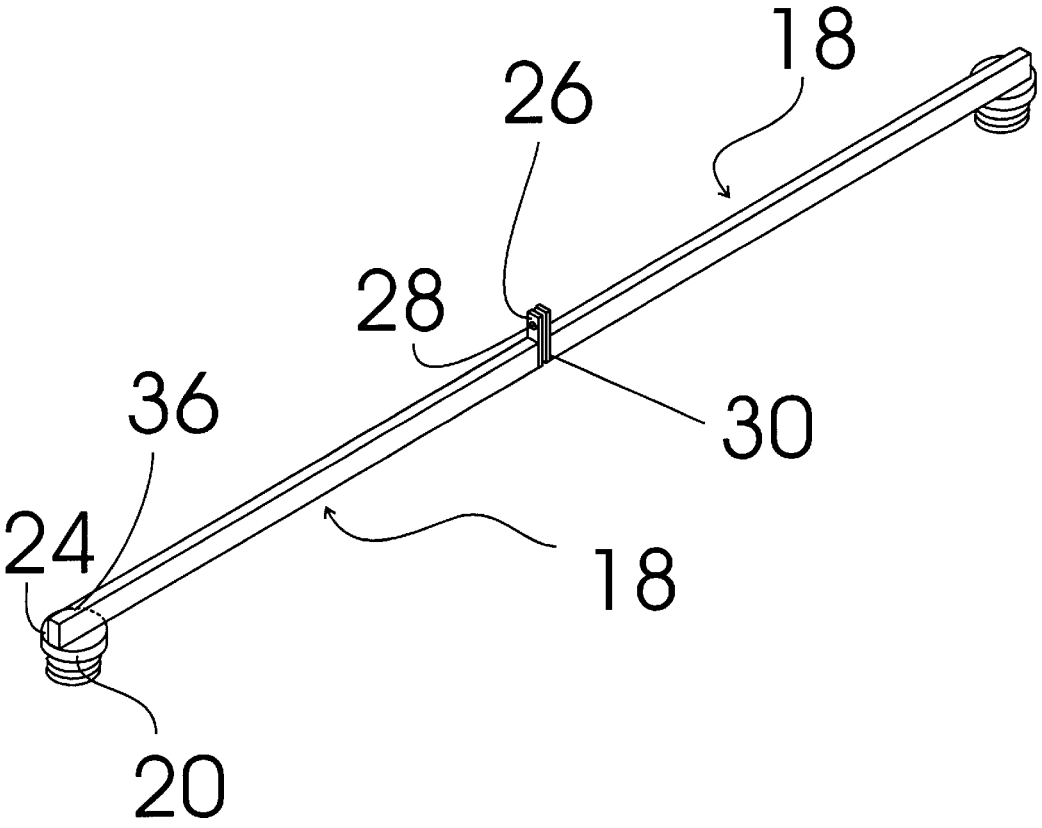
FIG. 2 is a perspective view of two identical exemplary embodiments of the drum plug assemblies of the drum security system of the present invention, each drum plug assembly including a threaded drum sealing plug threaded for engaging and sealing one of the two threaded drum access apertures of the drum top, a locking bar assembly rigidly secured at one bar end to a top of the threaded drum sealing plug and having a locking plate with a lock bolt receiving aperture provided at a second bar end thereof; the drum plug assembly measuring one half of the predetermined access opening gap distance between a center point of the drum top of the threaded drum sealing plug and the locking plate.
Figure 3:
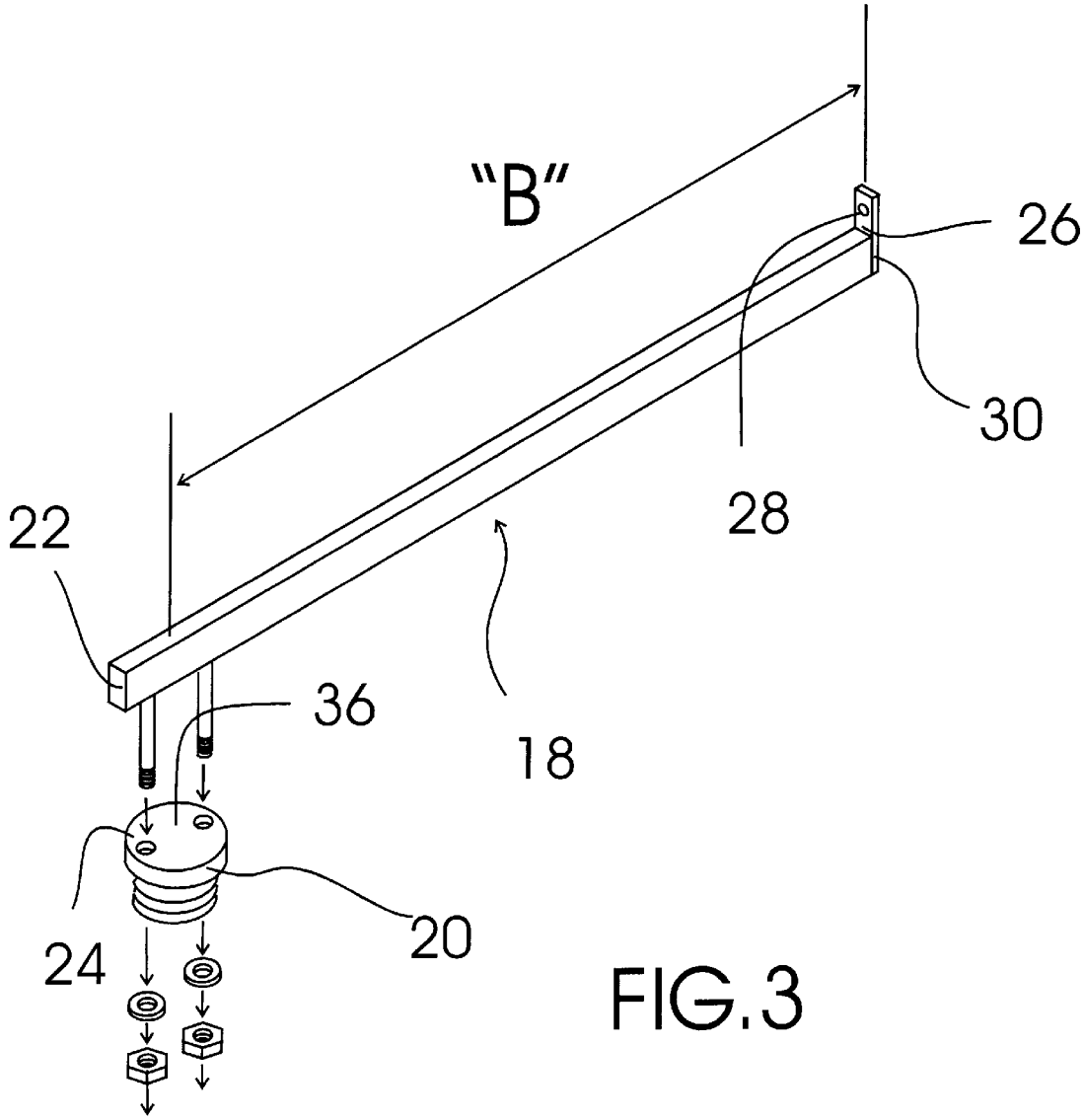
FIG. 3 is an exploded perspective view of one of the drum plug assemblies of FIG. 3 in isolation.
Figure 4:
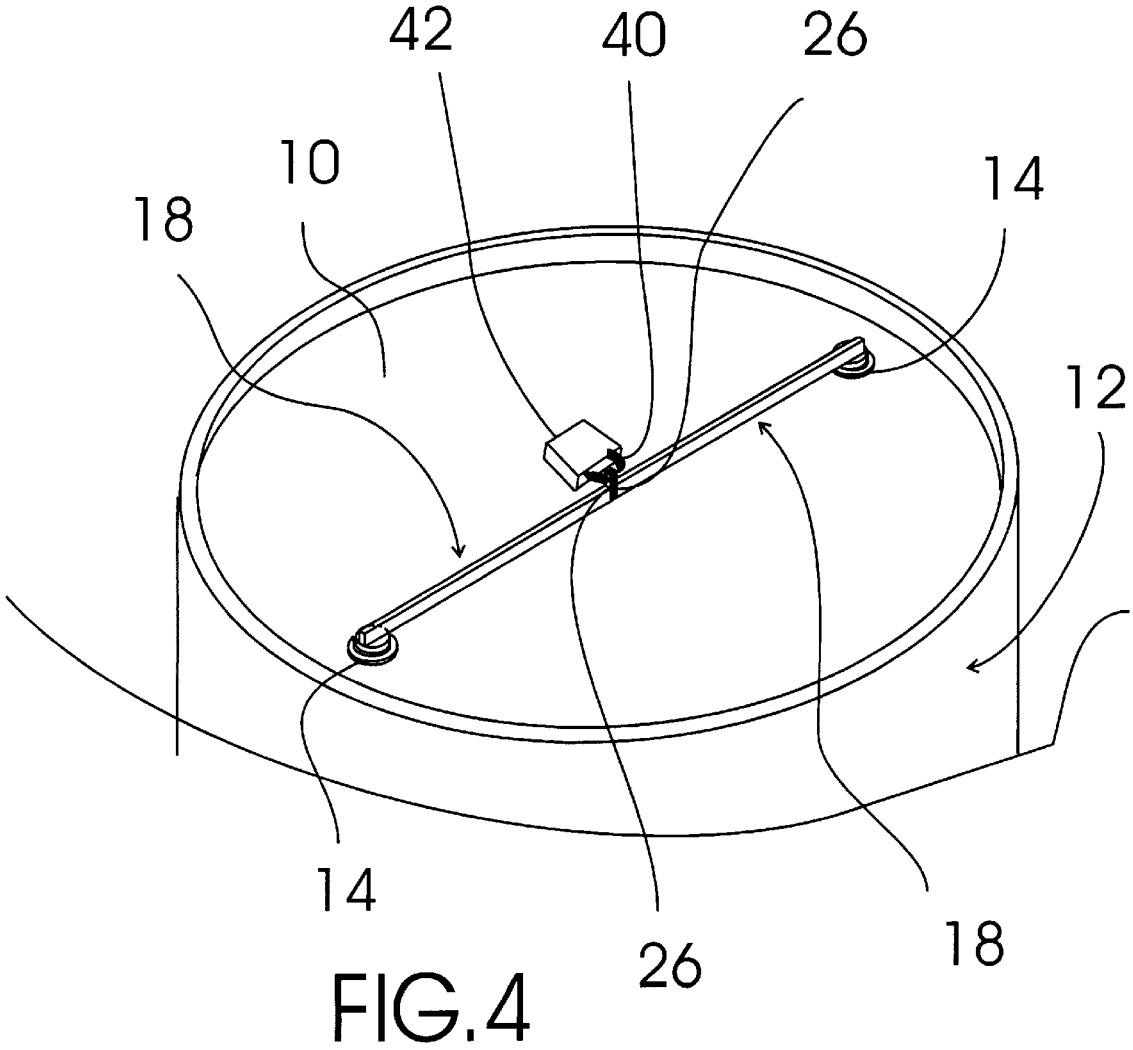
FIG. 4 is a partial perspective view showing the drum top mounted on a drum container, each of the two spaced threaded drum access openings sealed with one of the two identical drum plug assemblies, and the locking plates of the two identical drum plug assemblies locked together by the bolt of a padlock positioned through the two lock bolt receiving apertures thereof.

Referring to FIGS. 2 and 3, the drum security system of the present invention also includes two identical drum plug assemblies, each generally designated 18. Each drum plug assembly 18 includes a threaded drum sealing plug 20 threaded for engaging and sealing one of the two threaded drum access apertures 14 of drum top 10 (FIG. 1), and a locking bar assembly, generally designated 20, rigidly secured at one bar end 22 to a top 24 of threaded drum sealing plug 20 and having a locking plate 26 with a lock bolt receiving aperture 28 provided at a second bar 30 end thereof. Drum plug assembly 18 measures a distance "B" equal to one half of the predetermined access opening gap distance "A" (FIG. 1) between a center point 36 of drum top 24 of threaded drum sealing plug 20 and locking plate 26.

Referring generally to FIGS. 1–4, in use drum top 10 is mounted on or provided with a drum container 12, each of the two spaced threaded drum access openings 14 are then sealed with one of the two identical drum plug assemblies 18 by screwing in a threaded drum sealing plug 20. The drum plug assemblies 18 are then secured in place sealing the threaded drum access openings 14 by securing the two locking plates 26 of the two identical drum plug assemblies 18 together with the bolt 40 of a padlock 42 positioned through the two lock bolt receiving apertures 28.

It can be seen from the preceding description that a drum security system has been provided that includes a drum top having two spaced threaded drum access openings spaced apart on centers a predetermined access opening gap distance; and two identical drum plug assemblies; each drum plug assembly including a threaded drum sealing plug threaded for engaging and sealing one of the two threaded drum access apertures of the drum top, a locking bar assembly rigidly secured at one bar end to a top of the threaded drum sealing plug and having a locking plate with a lock bolt receiving aperture provided at a second bar end thereof; the drum plug assembly measuring one half of the predetermined access opening gap distance between a center point of the drum top of the threaded drum sealing plug and the locking plate.

It is noted that the embodiment of the drum security system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A drum security system comprising:

a drum top having two spaced threaded drum access openings spaced apart on centers a predetermined access opening gap distance; and two identical drum plug assemblies;

each drum plug assembly including a threaded drum sealing plug threaded for engaging and sealing one of said two threaded drum access apertures of said drum top, a locking bar assembly rigidly secured at one bar end to a top of said threaded drum sealing plug and having a locking plate with a lock bolt receiving aperture provided at a second bar end thereof;

each said drum plug assembly being of a length equal to one half of said predetermined access opening gap distance between a center point of said drum top of said threaded drum sealing plug and said locking plate.

* * * * *